US005605049A

United States Patent [19]

Moore et al.

[11] Patent Number: 5,605,049

[45] Date of Patent: Feb. 25, 1997

[54] EXHAUST SYSTEM FOR A CRYOGENIC FREEZER

[75] Inventors: Earl W. Moore, Macungie; David J. Klee, Emmaus, both of Pa.

[73] Assignee: Air Products and Chemicals, Inc., Allenwton, Pa.

[21] Appl. No.: 23,263

[22] Filed: Feb. 25, 1993

Related U.S. Application Data

[63] Continuation of Ser. No. 759,261, Sep. 13, 1991, abandoned.

[51] Int. Cl.[6] ..... F25D 13/06

[52] U.S. Cl. ..... 62/63; 62/186

[58] Field of Search ..... 62/63, 186, 179, 62/324

[56] References Cited

U.S. PATENT DOCUMENTS

| | | | |
|---|---|---|---|
| 3,345,828 | 10/1967 | Klee et al. | 62/63 |
| 3,403,527 | 10/1968 | Berreth et al. | 62/266 |
| 3,813,895 | 6/1974 | Klee et al. | 62/266 |
| 3,892,104 | 7/1975 | Klee et al. | 62/186 |
| 4,528,819 | 7/1985 | Klee | 62/63 |
| 4,627,244 | 12/1986 | Willhoft | 62/63 |
| 4,783,972 | 11/1988 | Tyree, Jr. et al. | 62/186 X |
| 4,800,728 | 1/1989 | Klee | 62/63 |
| 4,947,654 | 8/1990 | Sink et al. | 62/186 |
| 4,955,206 | 9/1990 | Lang et al. | 62/186 |
| 5,054,242 | 10/1991 | Klee | 62/63 |

*Primary Examiner*—John C. Fox
*Attorney, Agent, or Firm*—James C. Simmons

[57] ABSTRACT

Method and apparatus for controlling removal of gaseous cryogen from a continuous tunnel type freezer wherein the cryogen and product to be frozen travel in counterflow heat exchange relation to minimize ambient atmosphere moving into the tunnel and out of the exhaust system with the exhausted gaseous cryogen.

1 Claim, 2 Drawing Sheets

EXHAUST SYSTEM FOR A CRYOGENIC FREEZER

This is a continuation of application Ser. No. 07/759,261 filed Sep. 13, 1991, now abandoned the Specification which is incorporated by reference herein.

TECHNICAL FIELD

The present invention relates to tunnel-type cryogenic food freezers such as shown and described in U.S. Pat. No. 3,892,104, wherein the product (e.g. food) to be refrigerated and in some cases frozen moves through an elongated tunnel in counterflow relationship to vapors of the cryogen used to effect final freezing of the product.

BACKGROUND OF THE PRIOR ART

One of the more prevalent types of freezers used to provide cryogenic freezing of a product (e.g. foodstuffs) is a continuous, in-line tunnel that utilizes liquid nitrogen as an expendable refrigerant. One such apparatus in commercial use is shown in U.S. Pat. No. 3,813,895 and U.S. Pat. No. 3,892,104, the specifications of both patents being incorporated herein by reference. The apparatus of the prior art can achieve high thermal efficiency because it is designed as a counterflow heat exchanger. The product moves through the tunnel on a continuous belt from an entry end (portal or opening) to a discharge end (portal or opening). Liquid nitrogen is sprayed onto the food product at a location adjacent to the discharge end (opening) of the freezer. The cold nitrogen gas, at −320° F. (−196° C.), evolved in the liquid nitrogen spray zone, moves through multiple zones of gas recirculation as it flows toward the entrance of the freezer. Since the maximum available refrigeration has been utilized at that point, the warmed nitrogen gas can then be vented to the outside atmosphere by an exhaust system placed proximate the entry end of the tunnel.

Liquid nitrogen that is in equilibrium at 35.0 psia (241 kpa) has a latent heat of 80.5 BTU/lb. (187 J/g) when vaporized at atmospheric pressure. When the product enters the freezer at 75° F. (24° C.), the nitrogen gas will leave the freezer entrance at approximately 0° F. (−18° C.) in a freezer such as shown in the aforementioned patents and offered for sale by Air Products and Chemicals, Inc. as a CRYO-QUICK® freezer. At these conditions the freezer is operating at optimum thermal efficiency and the nitrogen gas will have a sensible heat of 79.5 BTU/lb. (185 J/g). Thus, the liquid nitrogen has a total available refrigeration of 160 BTU/lb. (372 J/g). Since the sensible heat of the nitrogen gas is almost one-half of the total available refrigeration, it is necessary to provide correct nitrogen gas flow through the freezer to achieve high thermal efficiency.

The amount of liquid nitrogen injected into the freezer will depend upon the amount of refrigeration required by the product to be frozen (e.g. foodstuff). Further, whenever production is interrupted, the liquid nitrogen flow rate should be reduced substantially to maintain the freezer at its operating temperature. In a typical CRYO-QUICK freezer, having a conveyor belt of 28" (711 mm) width and a length of 66' (20 m), the liquid nitrogen flow rate will vary from 3065 to 358 lb/hr (1390 to 162 kg/hr). In addition, the most efficient operation is obtained when the liquid nitrogen flow is shut off completely during the production interruption. If the production is stopped for a long period of time, then liquid nitrogen is readmitted to the freezer based upon the temperature within the freezer. Thus, the nitrogen gas flow through the freezer must change over a wide range from the maximum flow to zero flow.

If the gas flow control system moves a larger volume of gas than the amount of gaseous nitrogen evolved in the liquid nitrogen spray zone, warm room air will be pulled into the discharge opening of the freezer. The entry of warm room air will be a significant heat input, causing a loss of thermal efficiency. Further, the moisture contained in the room air will result in frost and ice accumulation within the freezer and impair its performance. If the gas flow control system moves a smaller volume than required, cold nitrogen gas will spill out of the discharge opening, causing a significant loss in thermal efficiency. Also, the nitrogen gas spilling into the processing room can cause an oxygen deficient condition that could result in a serious safety hazard.

In early freezers represented by U.S. Pat. No. 3,345,828, to insure that the cold gas would flow countercurrent to the product flow, parallel fans were employed in the tunnel. A thermocouple placed at the collection point of cold gas, where it interfaces with warm gas, was used to detect the level of the hot/cold interface and to change position of a damper (76) to equalize volume of circulation between the parallel flow fans. While this method proved satisfactory for freezers employing parallel flow fans, patentees in U.S. Pat. No. 3,403,527 improved this apparatus by employing additional dampers with the parallel flow fans.

Subsequent to the early parallel flow fan type freezers, it was discovered that a radial flow fan could be used to force the gas in countercurrent flow to the product. U.S. Pat. No. 3,813,895 discloses the type of freezer using all radial fans wherein a curved damper, which is temperature actuated, can be used to control the total flow of gas in the freezer. However, it was found that this apparatus performed satisfactorily on freezers of small dimensions (e.g. tunnel length of 22 ft. or less). The patentees in U.S. Pat. No. 3,892,104 employed a centrifugal fan to move the cold cryogen toward the entry end of the tunnel. Control of the fan and hence control of the movement of gas through the tunnel was effected by sensing the spray header pressure which in turn controlled the speed of the fan.

U.S. Pat. No. 4,528,819 discloses an immersion-type cryogenic freezer suitable for freezing foodstuffs wherein movement of the vaporized cryogen is in concurrent flow with the movement of the product through the freezer. Patentees disclose control of an exhaust fan to control the direction of vaporized nitrogen flow, which in turn prevents air insufflation into the freezer. However, an exhaust fan cannot be used effectively in a tunnel type freezer to move the vaporized cryogen through the freezer. When the freezer is more than 30 ft long, the exhaust fan is unable to move a sufficient volume of vaporized cryogen through the freezer. Although an exhaust fan could be used on smaller freezers, the exhaust fan will also pull room air through the entry end opening of the freezer. When moist room air is mixed with the vaporized cryogen, the moisture will become frost that will clog the exhaust duct. This condition is most severe when the vaporized cryogen is colder than −50° F. and the relative humidity of the room air is greater than 50%.

A conventional CRYO-QUICK freezer with a control system according to that shown in U.S. Pat. No. 4,800,728 employs a constant speed exhaust blower that is selected for a capacity at least one and one-half times the volume of nitrogen gas to assure safe operation. However, when the freezer is operated within a refrigerated room to freeze a cool product, such as a hamburger patty at 32° F. (0° C.), a constant speed exhaust blower is not satisfactory. When processing a cool product, the entrance temperature of the freezer becomes substantially colder, i.e. −50° F. (−46° C.). The excess capacity of the exhaust blower (fan) draws a large volume of room air into the entrance opening of the freezer. As the room air enters the entrance opening, it impinges on the conveyor belt, warming the conveyor belt and increasing the heat loss into the freezer. Further, the warm, moist room air impinging on the cold −50° F. (−46° C.) conveyor belt deposits a layer of frost on the woven wire belt. Over a period of time, the frost layer thickens to restrict the openings in the conveyor belt. When this occurs, the recirculated nitrogen gas cannot pass through and under the conveyor belt. As a result, the bottom surface of the food product will not be adequately frozen.

Another problem with a constant speed exhaust blower is that warm, moist room air is mixed with cold nitrogen in the exhaust duct. When the freezer entrance temperature is −50° F. (−46° C.) or colder, the moisture forms frost that tends to accumulate within the exhaust duct. As the exhaust duct becomes clogged with frost, the flow through the exhaust system is restricted causing a potentially hazardous situation.

When using a constant speed exhaust blower another problem arises in regard to removal of refrigerated air from the processing room. Warm make-up air must enter the processing room to offset this loss, thereby significantly increasing the amount of mechanical refrigeration required to maintain the room at temperature, i.e. +50° F. (10° C.).

When the freezer is cold but not producing frozen food, such as during a lunch break, the LIN flow to the freezer is reduced to about 15% to maintain the freezer at operating temperature. Under those conditions, a constant speed exhaust blower tends to pull additional room air into the discharge opening of the freezer. The warm, moist air entering the discharge opening of the freezer increases the heat losses of the freezer. Further, the moisture forms frost that clogs the freezer, further impeding satisfactory performance.

For those reasons, it is desirable to provide an exhaust system with variable volume that is automatically adjusted to remove only nitrogen gas from the freezer with a minimum of room air.

The known solution to the problem of providing a variable volume exhaust blower employs a pressure transducer to detect the amount of LIN entering the freezer by sensing the pressure in the LIN spray header. In the first version of this system, the pressure transducer provided the speed signal to a DC power supply that varied the speed of a DC motor driving the exhaust blower. In the present system, the pressure transducer provides a speed signal to an AC inverter that varies the speed of an AC motor driving the exhaust blower. Although this system can perform satisfactorily during continuous production, it has several disadvantages. The nitrogen gas is delivered to the entrance of the freezer by a temperature activated gas flow control, e.g. U.S. Pat. No. 4,800,728, that operates independently of the LIN spray header pressure. Thus, during a process upset, the LIN spray pressure may change suddenly without a corresponding change in the gas flow fan speed. Consequently, the exhaust blower may slow down while the gas flow fan is still delivering a large volume of nitrogen gas to the freezer entrance.

Another disadvantage of this system is that it requires a LIN spray header pressure that is high enough to produce the required exhaust blower speed. Since the pressure transducer in the present system has a range of 0 to 10 psi (0 to 69 kPa), the LIN spray header pressure must be 10 psi (69 kPa) to operate the exhaust blower at full speed. In those cases where the LIN spray header pressure is 5 psi (34 kPa) or less, the exhaust blower may not operate at sufficient speed to remove all the nitrogen gas delivered to the freezer entrance.

Another disadvantage of this system is the fact that the mass flow through the LIN spray header is not constant with constant spray header pressure. If the equilibrium condition of the liquid nitrogen, as indicated by the LIN storage tank pressure, changes significantly, the quality of the LIN flowing through the spray nozzles will also change. For that reason, the LIN spray header pressure will be different for the same mass flow of liquid nitrogen. This same condition will occur if one or more of the LIN spray nozzles becomes clogged with debris. When either of these situations occur, the freezer operator must readjust the system to obtain the proper exhaust blower speed.

BRIEF DESCRIPTION OF THE INVENTION

It has been discovered that removal or exhausting of cryogen gas from the continuous cryogenic food freezer can be controlled by placing an exhaust fan or positive fluid mover in the exhaust system of the freezer. The exhaust fan is driven by a variable speed motor connected to a motor controller which in turn is connected to the motor controller which controls the speed of the motor or motors which power the gas flow control fan or fans in the tunnel. Coupling the two motor controllers as taught herein provides for the speed of rotation of the exhaust blower (fan) to be controlled in the same direction (e.g. accelerated or decelerated) and to the same degree as the speed of rotation of the gas flow control fan. Thus the amount is minimized when exhausting vaporized cryogen from the freezer because the exhaust fan is controlled to react immediately to changes in the speed of rotation of the gas flow control fan. Thus, when the volume of vaporizing cryogen (e.g. nitrogen) delivered to the freezer entrance and exhaust duct changes, the exhaust fan speed changes to maintain the correct flow through the exhaust system with a minimum of operator intervention.

DETAILED DESCRIPTION OF THE INVENTION

Figure 1:
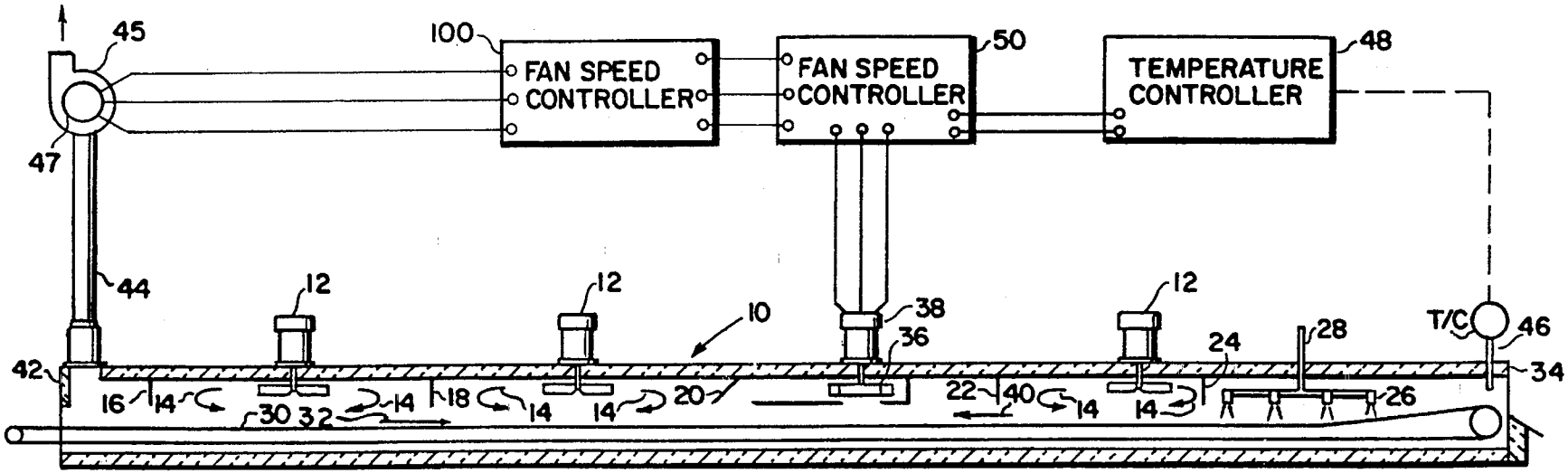
FIG. 1 is a schematic representation of a freezer to which the present invention has been applied.

Referring to FIG. 1, the numeral 10 depicts a cryogenic freezer or tunnel of the type shown in U.S. Pat. Nos. 3,813,895 or 3,892,104. Freezer or tunnel 10 includes a plurality of recirculating fans powered by a recirculating fan motor, each of which is shown as 12. Each of the recirculating fan and motor assemblies 12 recirculates vaporized cryogen inside the tunnel in accordance with the arrows 14, the recirculation paths being defined by a plurality of baffles 16, 18, 20, 22 and 24 disposed within the freezer in a manner adequately described in the prior art. Liquid cryogen (e.g. liquid nitrogen) is injected into the freezer by means of a spray header 26 and a liquid cryogen 28 (liquid nitrogen) conduit connected thereto. Liquid cryogen conduit 28 is in turn connected to a suitable source of supply such as a liquid cryogen tank (not shown) by means of piping as is known in the art. Disposed inside freezer 10 is a conveyor belt 30 which causes movement of product placed thereon in the direction shown by arrow 32. The liquid nitrogen spray header 26 is disposed near the discharge end 34 of freezer 10. Liquid nitrogen sprayed from the header 26 vaporizes causing a buildup of vaporized cryogen inside the tunnel 10 in the area adjacent to spray header 26. A gas control fan or blower 36 driven by a variable speed motor 38 causes the vaporized cryogen to move through the tunnel in the direction shown by arrow 40. The means of baffling and types of fans suitable for this purpose are also adequately described in the prior art. The freezer or tunnel 10 includes a product entry end 42 adjacent to which is placed an exhaust duct 44. Exhaust duct 44 includes a suitable exhaust fan or blower 45 driven by a variable speed motor 47 and is usually vented outside of the immediate area of the freezer to prevent oxygen depletion in the ambient atmosphere in which the freezer 10 is used.

Disposed adjacent the exit end 34 of the tunnel 10 is a thermocouple 46 which is connected to a temperature controller 48 which in turn is connected to a fan speed controller 50. Fan speed controller 50 is in turn connected to a second fan speed controller 100 which in turn is connected to motor 47 of fan 45.

Figure 2:
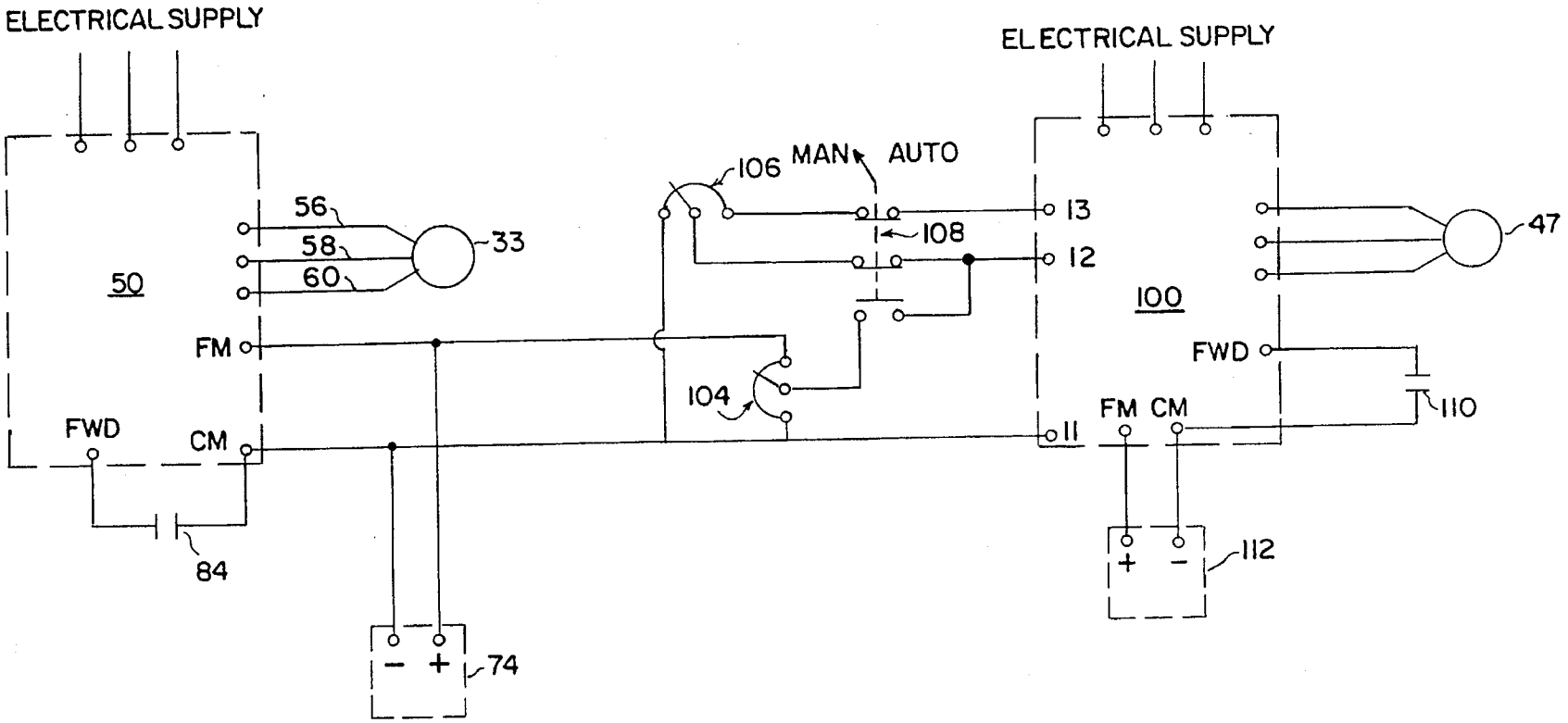
FIG. 2 is a simplified circuit diagram for the apparatus of the present invention.

The Improved Exhaust System for a Cryogenic Freezer is shown in FIG. 2. The gas flow fan controller 50 and its operation are the same as disclosed in the specification of U.S. Pat. No. 4,800,728 which disclosure is incorporated herein by reference. In automatic operation, the speed signal 0–10 mADC comes from a temperature controller with the control thermocouple mounted at the discharge opening of the freezer. The gas flow controller 50, such as "S" type manufactured by T. B. Wood's Sons Company of Chambersburg, Pa., and sold under the trademark E-TRAC, has two terminals labeled FM and CM. These terminals provide a 0 to +10 volt DC signal that is proportional to the output frequency of the controller 50. If this signal is connected to the speed signal terminals 11 and 12 of a second controller 100 similar to controller 50, the second controller will produce the same output speed as the first controller 50 over the entire speed range.

Because the size of a CRYO-QUICK freezer can vary in conveyor belt width from 28 to 50" (711 to 1270 mm) and can vary in length from 31 to 81 ft. (9.45 to 24.7 m), the freezer may have one, two, or four gas flow fans. Further, at least three different size exhaust blowers are used as the freezer size increases. Thus, to achieve the proper exhaust blower speed, it is necessary to modify the system to operate the exhaust blower proportionally slower or faster than the gas flow fan motor. An automatic adjustment potentiometer 104 is inserted across terminals FM and CM of the gas flow controller 56 to act as a voltage divider. As the potentiometer 104 is adjusted from maximum resistance to a lower value, the speed signal delivered to the exhaust blower controller 100 is proportionally reduced, allowing the exhaust blower 45 to operate proportionally slower than the gas flow fan motor.

The operating characteristics of the controllers 50 and 100 disclosed above can be modified by selecting the appropriate program codes that serve as instructions to the central processing unit. To operate the exhaust blower proportionally faster than the gas flow fan motor, program code 1014 sets the exhaust blower AC inverter speed range at 2.5 to 75 Hz, 25% faster than the gas flow AC inverter. However, the exhaust blowers used with the freezer have a maximum speed of 60 Hz when driven by a typical AC induction motor. Thus, it is necessary to limit the maximum speed of the exhaust blower to 60 Hz to prevent overloading the motor. This is accomplished with program code 1208, that limits the maximum speed to 80% of the speed range, i.e. 60 Hz.

The improved exhaust system has provision to operate the exhaust blower 45 controller 100 manually in the event of a malfunction. This is accomplished by a manual speed potentiometer 106 and electrical contacts 108 that are operated by a maintained contact pushbutton, a selector switch or a control relay. The electrical contacts, as shown in FIG. 2, are in the position for manual operation and the exhaust blower speed is varied by turning potentiometer 106.

The electrical contact 110 across terminals FWD and CM is closed to start the motor 47 of exhaust blower 45.

Frequency meters 74 and 112 are added to controllers 50 and 100 to inform the freezer operator of the gas flow fan motor speed and exhaust blower speed during operation. The E-Trac "S" type AC inverter has a potentiometer ADO that can be adjusted to calibrate the frequency meters.

The only purpose for the exhaust blower on a CRYO-QUICK freezer is to remove the nitrogen gas, evolved within the freezer, from the processing room. This is necessary to prevent the accumulation of nitrogen within the processing room that could result in an oxygen deficient atmosphere. However, the nitrogen gas within the freezer must first be delivered to the freezer entrance by the gas flow fan.

The improved exhaust system solves the problem of removing nitrogen with a minimum of room air by responding immediately to changes in the speed of the gas flow fan. Thus, when the volume of nitrogen gas delivered to the freezer entrance changes, the exhaust blower also changes speed to maintain the correct flow through the exhaust system. In actual operation, the operator adjusts the system initially to establish the proper speed proportion between the gas flow fan 36 and the exhaust blower 45. This is done by slowing down the exhaust blower 45 with the automatic adjustment potentiometer 104 until the loading table of the freezer fills with cold nitrogen gas. The operator can readily observe the water vapor cloud formed by cold nitrogen gas as he adjusts the system. When the cloud fills the loading table without spilling over the sides, the exhaust system is properly calibrated to remove all of the nitrogen gas with a minimum of room air.

The improved exhaust system was installed on a CRYO-QUICK freezer model R9-2851-PO and properly adjusted for optimum operation. The following operating data was recorded from this test:

A. Food product 10:1 hamburger patty

B. Production rate 3024 lbs. meat/hour

C. Patty spacing ¼"–⅜"

D. Retention time 1.79 minutes

E. Entrance controller, actual −54° F. setpoint −100° F.

F. Honeywell LIN controller #55

G. Gas flow controller, actual 0° F. setpoint 0° F.

H. Gas flow fan speed 40 Hz

I. Exhaust fan speed 35 Hz

J. Exhaust AUTO potentiometer #760

K. LIN spray header pressure 5.2 psi

L. Motorized LIN valve position 3:35 pm

M. Discharge gas spill—correct

The exhaust fan operated automatically to remove the nitrogen gas without removing a significant quantity of room air.

When an improved exhaust system according to the invention is installed on a freezer and properly calibrated, the following benefits are realized:

A. Since the conveyor belt is surrounded by cold nitrogen gas, it is not warmed by room air, thus reducing the heat losses into the freezer by as much as 40%.

B. Since room air does not impinge on the conveyor belt, frost accumulation on the conveyor belt is dramatically reduced, thereby allowing optimum gas recirculation through the conveyor belt for uniform, consistent cooling of the top and bottom surfaces of the food product.

C. Because a minimum amount of moist room air enters the exhaust system, the accumulation of frost within the exhaust system is greatly reduced providing more safe operation of the freezer.

D. Since the minimum amount of refrigerated air is removed from the processing room, less mechanical refrigeration is required to maintain the temperature of the processing room, a significant savings of electrical energy.

Under some circumstances when the freezer is not producing frozen food, the LIN flow may be shut off allowing the gas flow fan to operate at minimum speed, 3 Hz. Although the gas flow fan will not deliver an appreciable amount of nitrogen to the freezer entrance, gravity will pull some nitrogen through the freezer because it is inclined for drainage of cleaning water. To compensate for that condition, program code 1309 will establish the minimum speed for the exhaust blower at 16.9 Hz, which is sufficient to remove that nitrogen.

The primary advantage of the improved exhaust system over the existing system is that it is not affected by a process upset to the LIN control system. Wherever the gas flow fan delivers more nitrogen to the freezer entrance, the exhaust blower changes speed immediately to react to the new nitrogen flow condition.

Having thus described our invention what is described to be secured by Letters Patent of the United States is set forth in the appended claims.

We claim:

1. In a process for quick freezing a product utilizing a vaporizing cryogen passed by means of a variable speed gas flow control fan in counterflow heat exchange with said product passing through a tunnel-type freezer having an entry portal with a loading table and an exit portal and a system including an exhaust blower for removing vaporized cryogen from said freezer, the improvement comprising:

establishing the flow of vaporizing cryogen within said freezer by establishing the relationship of the speed of rotation of the gas flow control fan to the speed of rotation of the exhaust blower until the loading table fills with cold nitrogen gas as evidenced by a water vapor cloud formed by the cold nitrogen gas contacting ambient atmosphere outside of said freezer, and adjusting the speed of said exhaust blower to maintain said cloud on said loading table without spilling off said table.

* * * * *